US005363011A

United States Patent [19]

Fendley

[11] Patent Number: 5,363,011

[45] Date of Patent: Nov. 8, 1994

[54] STRIP-TYPE SHADOW MASK EFFECTIVE TO ALLEVIATE DEGROUPING

[75] Inventor: James R. Fendley, Arlington Heights, Ill.

[73] Assignee: Zenith Electronics Corporation, Glenview, Ill.

[21] Appl. No.: 974,443

[22] Filed: Nov. 12, 1992

[51] Int. Cl.[5] ..... H01J 29/81; H01J 29/07

[52] U.S. Cl. ..... 313/408; 313/402

[58] Field of Search ..... 313/402, 403, 404, 407, 313/408

[56] References Cited

U.S. PATENT DOCUMENTS

| | | | |
|---|---|---|---|
| 2,842,696 | 7/1958 | Fischer-Colbrie . | |
| 3,638,063 | 1/1972 | Tachikawa et al. . | |
| 4,859,549 | 8/1989 | Hayashi | 313/408 |
| 4,893,054 | 1/1990 | Kobayashi | 313/408 |
| 4,900,977 | 2/1990 | Lopata et al. | 313/408 |
| 5,216,321 | 6/1993 | Kawamura et al. | 313/408 |

FOREIGN PATENT DOCUMENTS

| | | | |
|---|---|---|---|
| 2138613 | 2/1973 | Germany | 313/402 |

*Primary Examiner*—Donald J. Yusko
*Assistant Examiner*—N. D. Patel
*Attorney, Agent, or Firm*—Ralph E. Clarke, Jr.; Roland W. Norris

[57] ABSTRACT

A striped-screen tension mask color CRT has a flat glass face with stripes of trios of colored-light-emitting phosphors deposited on its inner surface. An associated strip-type shadow mask has a predetermined downward curvature from center to sides effective to alleviate degrouping of electron beams when the tube is activated.

4 Claims, 3 Drawing Sheets

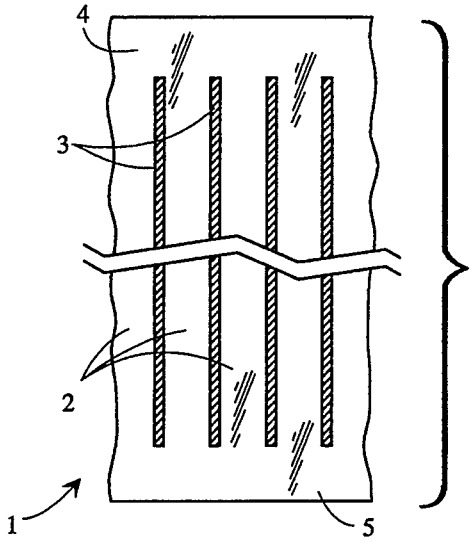
Fig. 1
PRIOR ART
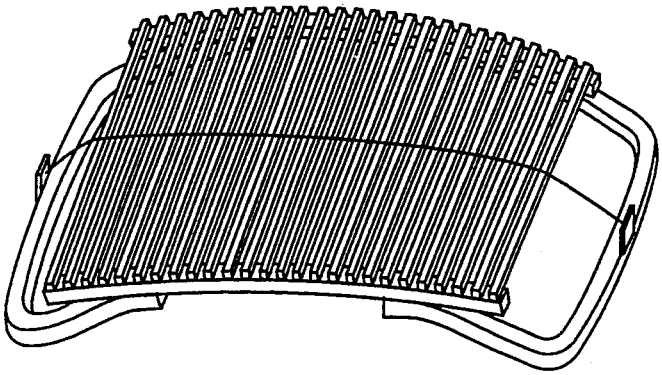
Fig. 3
PRIOR ART
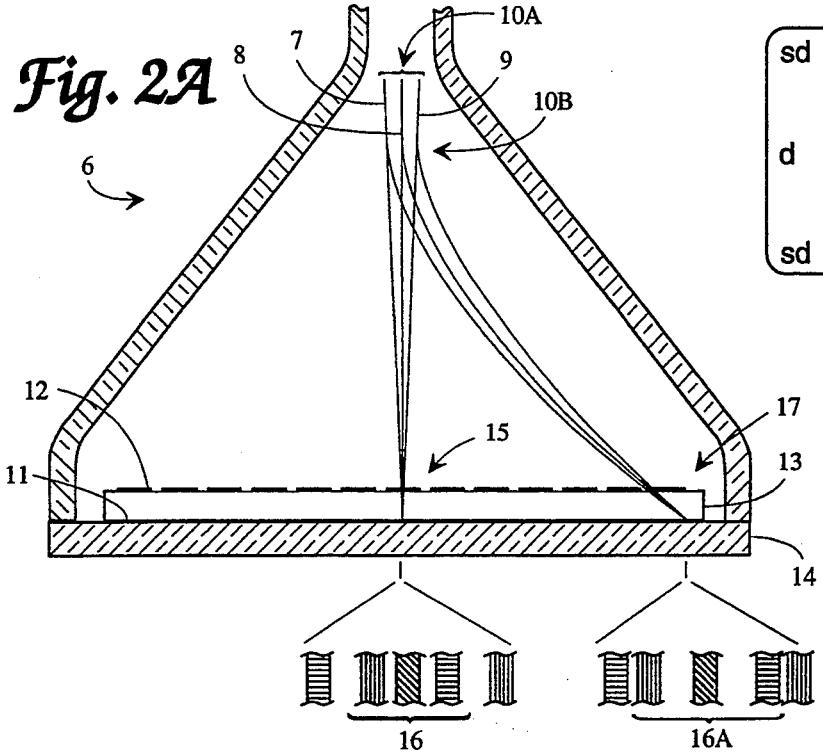
Fig. 2A
| | | |
|---|---|---|
| sd | d | sd |
| d | g | d |
| sd | d | sd |
Fig. 2C
Fig. 2B

STRIP-TYPE SHADOW MASK EFFECTIVE TO ALLEVIATE DEGROUPING

CROSS REFERENCE TO RELATED APPLICATIONS

This application is related to but in no way dependent upon copending application Ser. No. 07/998,093 filed Dec. 28, 1992, and of common ownership herewith.

BACKGROUND OF THE INVENTION

1. Field of the Invention

This invention relates to color cathode ray picture tubes, and is addressed specifically to an improved tension shadow mask and its support structure as used in cathode ray tubes having a flat faceplate and a striped screen.

A shadow mask is a part of the cathode ray tube (CRT) front assembly, and is located in close adjacency to the screen. The shadow mask is an apertured metal component that acts as a color-selection electrode, or "parallax barrier," which ensures that each of the three beams generated by the electron gun located in the neck of the tube lands only on assigned phosphor targets on the screen.

The mask is positioned in a predetermined relationship with the screen by two or more mask support structures affixed to the inner surface of the faceplate, and which are referred to hereafter as "rails." The apertured foil that comprises the mask is stretched over the rails and welded to a mask-receiving surface on the rails. In tubes having a flat faceplate and a flat tension mask ("FTM" tubes), the mask is spaced a predetermined, constant distance from the screen by the rails, a dimension known as the Q-spacing.

The type of shadow mask of interest in the present disclosure is categorized as the strip mask, depicted schematically in FIG. 1. Strip mask 1 consists of thin strips 2 of metal which extend the full height of the imaging screen, and which are separated by slits 3. The strips 2 are attached to skirts 4 and 5 which in turn are affixed to the mask-receiving surface of two rails located on opposed sides of the screen (not indicated). Stripes of light-emitting phosphor corresponding to the slits 3 are printed on the screen. This type of screen, referred to in the present disclosure as a striped screen, is also known as a line screen.

The strip mask 1 shown by FIG. 1 is formed from a metallic foil which may have a thickness of 0.0003 inch to 0.002 inch, with the thickness dependent upon the size and application of the CRT. Such thin foils are basically non-self-supporting so they must be installed in a highly tensed state on the rails. By way of example, the tension of a foil mask for a 14-inch (diagonal measure) CRT is about 30 kpsi.

As with all types of shadow masks, the problem of degrouping is present in strip masks. Degrouping is a condition in which the adjacent trios of electron beams become increasingly crowded as a function of distance from the center of the screen. Degrouping has the undesired effects of reducing useful illumination at the sides and corners of the screen, and the dilution of the color image.

Degrouping is caused primarily by (1) the movement of the deflection center of the electron beams toward the screen with increase in the deflection angle of the beams as they move toward the sides of the screen, and (2) the influence of the yoke.

Regarding (1), the first cause: please refer to FIG. 2A, which depicts the paths of undeflected and deflected trios of electron beams. An electron gun (not indicated) of a CRT 6 emits three beams 7, 8 and 9. The beams pass through a shadow mask 12 mounted on rail(s) 13 affixed to faceplate 14. Each of the beams 7, 8 and 9 impinges upon a specific color in the trios of red, green, and blue-light emitting phosphor stripes deposited on screen 11. If the color phosphor stripes are printed on the panel to correspond with the landing areas of the respective beams which excite them, adjacent trios of phosphor stripes become crowded during the printing process.

The status of representative trios of electron beams at the center and the corners of the screen 11 are depicted in FIG. 2B, with the color that each of the three beams excites—whether red, green or blue—indicated symbolically. It is to be understood that the trios depicted are segments of electron beams that extend the full height of the screen 11. The intra-trio grouping (i.e., grouping of beams within trios) depicted in FIG. 2B is typical of a flat tension mask supported by rails having a constant Q-spacing. When the beams 7, 8 and 9 fall on the patterns of stripes at or near the center 15 of screen 11, they deflect at deflection center 10A. The trios of electron beams at center 15 are said to be "grouped"; that is, the intra-trio beam spacing is less than the inter-trio beam spacing (spacing between trios), a grouping illustrated by group 16 in FIG. 2B.

However, when beams 7, 8 and 9 are deflected toward the corners of the screen 11, for example at corner location 17, the trios of beams, represented by trio 16A, become "degrouped," or spaced apart as indicated by FIG. 2B. The intra-trio degrouping is a function of the deflection angle of the beams 7, 8 and 9: as the beams move toward the sides or corners of the screen 11, the effective deflection center, indicated by beam deflection center 10B, moves toward the screen 11. As a result, the trios become degrouped. This condition is shown by trio 16A, in which the red and blue outer beams crowd the respective blue and red outer beams of the adjacent trios.

The distribution of trio grouping and degrouping across a screen is indicated by FIG. 2C, in which the status of the trios is indicated by the symbols "g" for grouped, "d" for degrouped, and "sd" for severely degrouped. As indicated, degrouping is most severe in the corners of the screen.

With regard to item (2)—the influence of the yoke as a cause of degrouping, it is difficult to design a yoke which does not cause at least some degrouping. Some yoke designs will cause only minor degrouping, while in other designs, the degrouping will be severe. Effective yoke design is a process of many trade-offs, of which the extent of degrouping is only one.

Degrouping can be alleviated by printing the screen so that the phosphor stripes are narrower at the sides and corners of the screen in order to avoid loss of color purity. The penalty however is a reduction in brightness.

Degrouping can also be alleviated by grading the shadow mask; that is, by varying the pitch, or spacing of the strips, as a function of the distance from the center of the mask to its periphery. In a strip-type shadow mask for striped screens, the distance between the strips is increased about eight percent from the center of the mask to the sides. Such grading, however, undesirably coarsens the pattern of phosphor stripes at the sides of the screen. Further, the need to grade the mask complicates its manufacture.

Another remedy, a partial one, depends on a compromise in establishing the Q-distance. The extent of intra-trio degrouping depends on the spacing of the mask in relation to the screen. If the Q-distance is selected to avoid trio grouping at the center of the screen, adjacent trios of beams in the corners of the screen become unacceptably crowded; i.e., degrouped. By reducing the Q-distance, a slight but tolerable grouping will occur at the center of the screen, while the degrouping at the corners is alleviated.

2. Discussion of Related Art

A form of the strip mask, the subject of U.S. Pat. No. 3,638,063 to Tachikawa et al, is shown by FIG. 3. It is an etched mask consisting of a parallel array of narrow strips the ends of which are attached to a curved spring frame which holds the strips under tension, forming a sector of a cylindrical surface that is in parallel with a curved faceplate. The curvature of the spring frame is designed to conform to the curvature of the face panel with which it is associated. Disadvantages inherent in a mask assembly of this type include its bulk and weight and the complexity of its manufacture. Also, the strips tend to vibrate independently. As indicated in FIG. 3, the latter deficiency is remedied in Tachikawa et al by the stretching of one or more fine wires or fibers over the cylindrical surface, which serve to dampen vibration by contact with the strips.

Another form of strip mask, one that uses wires as the shadowing elements, is disclosed in U.S. Pat. No. 2,842,696 to Fischer-Colbrie.

OBJECTS OF THE INVENTION

It is an object of the invention to:

(a) provide means for mounting a strip shadow mask in a tension mask CRT that substantially eliminates the need for grading the pitch of the mask and the pitch of the phosphor lines on the screen to alleviate degrouping;

(b) provide means for compensating for the degrouping attributable to the yoke;

(c) provide a strip mask support structure in which the Q-spacing can be varied; and (d) provide a strip mask support structure that facilitates vibration damping of the strips of the mask.

BRIEF DESCRIPTION OF THE DRAWINGS

The features of the present invention believed to be novel are set forth with particularity in the appended claims. The invention, together with further objects and advantages thereof, may be best understood by reference to the following description taken in conjunction with the accompanying drawings (not to scale) the several figures of which like reference numerals identify like elements, and in which:

FIG. 1 a plan view of a representative section of a prior art strip mask composed of thin foil.

FIG. 2A is sectional view of the funnel and screen section of a CRT, with a schematic depiction of the excursion of the electron beams; FIG. 2B depicts schematically the effect on grouping of the beams and they move from the center of the screen to the corners; and FIG. 2C indicates the distribution of trio grouping and degrouping over the area of the screen.

FIG. 3 is a schematic view of a prior art strip mask mounted on a spring frame.

DESCRIPTION OF THE PREFERRED EMBODIMENT

Figure 4:
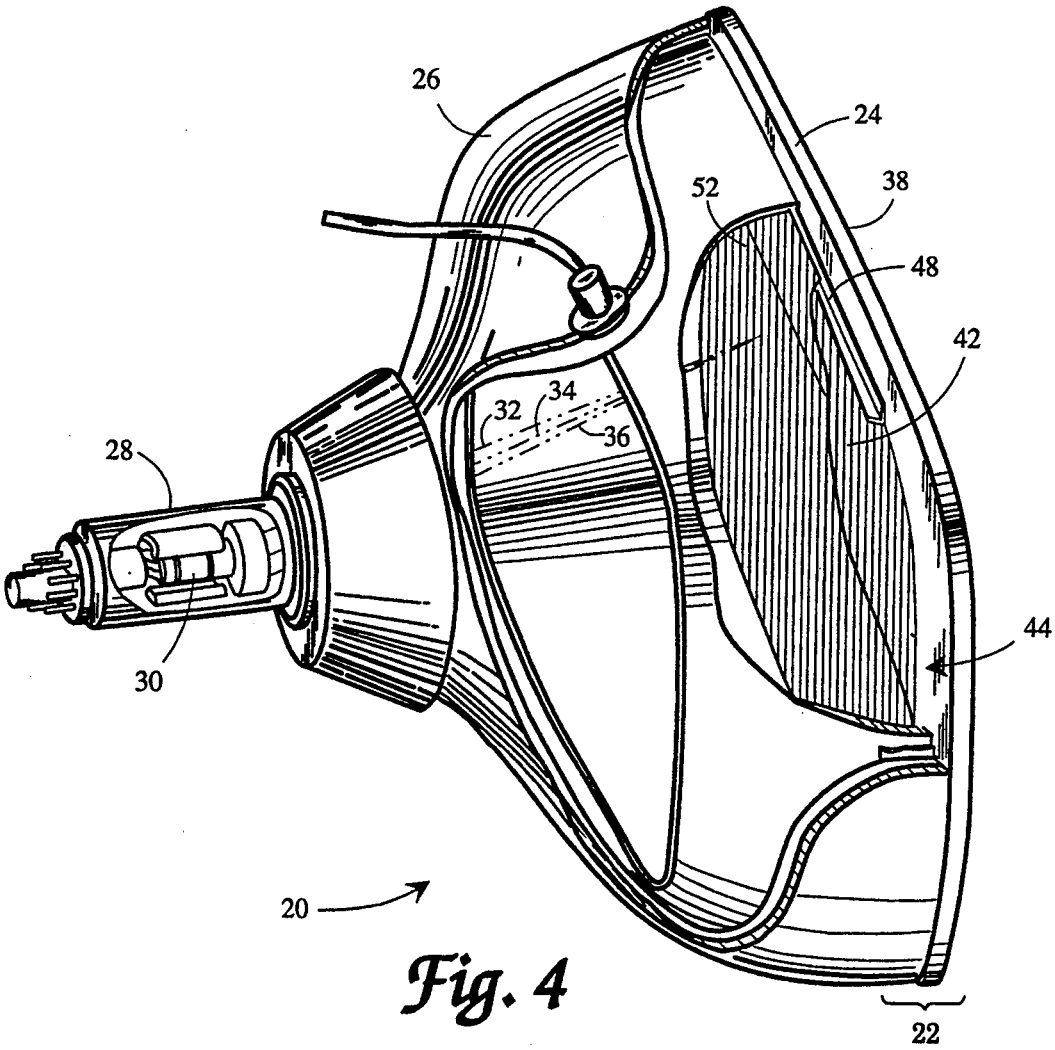
FIG. 4 is a side view in perspective of a striped-screen tension mask color CRT having an improved tension shadow mask and mask support structure according to the invention, with cutaway sections that reveal the location and relationship of the major components of the tube.
Figure 5:
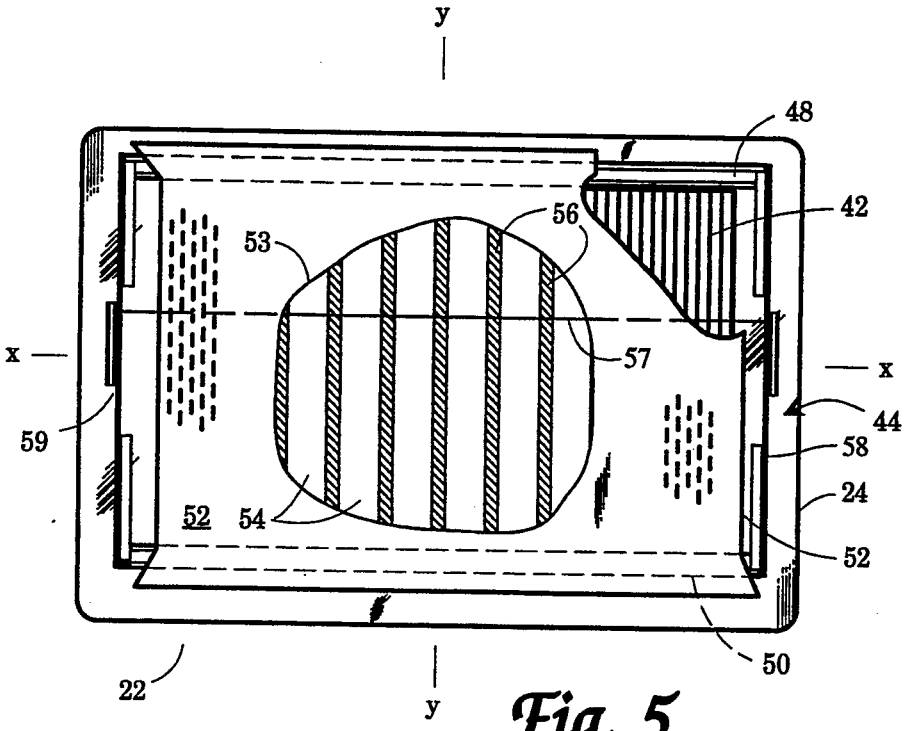
FIG. 5 is a view in elevation of the front assembly of the CRT of FIG. 4 as seen from the viewpoint of the electron gun, with parts cut away to show the relationship of a strip shadow mask with the faceplate and the striped screen; an inset depicts the strips of the mask greatly enlarged.

With reference to FIGS. 4 and 5 , a striped screen tension mask color cathode ray tube 20 has a front assembly 22 that includes a rectangular flat glass faceplate 24 sealed to a funnel 26 . The x-axis of the faceplate 24 , also known as the horizontal axis , and the y-axis , also known as the vertical axis, are indicated in FIG. 5. The x-axis and the y-axis crossing each other at the center of the screen.

The neck 28 of CRT 20 that extends from funnel 26 encloses an in-line electron gun 30 that projects three discrete electron beams 32, 34 and 36 that excite the stripes of phosphor deposited on screen 42 to produce a color image visible from the outer surface 38 of faceplate 24.

The centrally disposed striped screen 42 is deposited on a rectangular area on the inner surface 44 of faceplate 24. Striped screen 42 consists of patterns of spaced stripes comprising deposits of phosphor oriented in a first direction, indicated by FIG. 5 as being in the y-direction, by way of example. The stripes of phosphor may be interspersed with a matrix, or "black surround" (not shown).

Two shadow mask supports comprising rails 48 and 50 are affixed to the inner surface 44 of faceplate 24 on opposed sides of the screen 42 in a second direction perpendicular to the first direction for receiving a shadow mask 52; the second direction is indicated as the x-direction in FIG. 5. The mask 52 is in turn affixed to the rails 48 and 50 preferably by tack welding the borders of the mask to the underlying rails with a pulsed laser beam.

As depicted in the inset 53 in FIG. 5, which indicates a representative section of the shadow mask 52 greatly enlarged, it will be seen that shadow mask 52 is a strip mask of the type shown by FIG. 1, in which there is a plurality of strips 54 aligned in the first direction, and spaced apart as indicated by the intervening slits 56. Wire 57, lying in the second direction, and supported in tension by support bands 53 and 59 affixed to the ends of rails 48 and 50, is in contact with the strips 54 and provides for damping the vibration of the strips.

Figure 6:
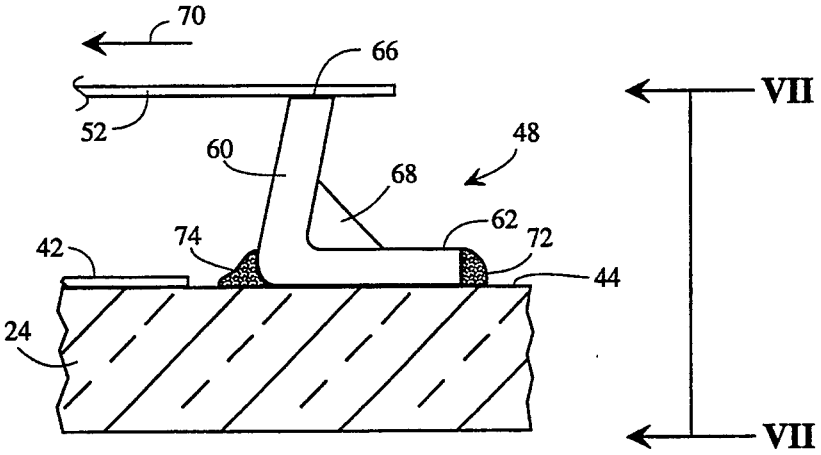
FIG. 6 is an end view of a strip shadow mask support structure having a novel configuration according to the invention.
Figure 7:
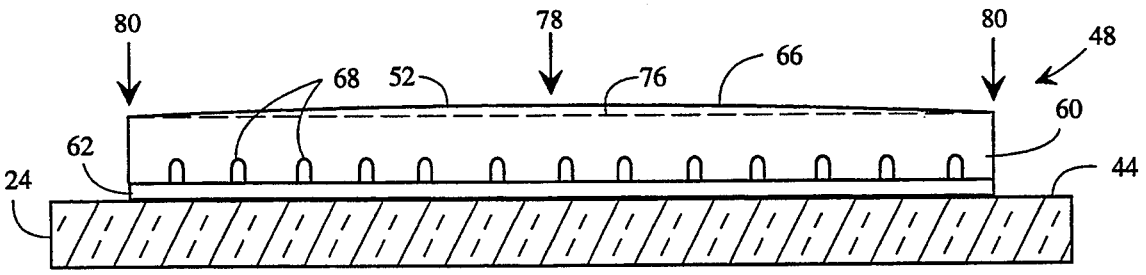
FIG. 7 is a view of the mask support structure of FIG. 6 taken along site lines VII—VII of FIG. 6.

FIGS. 6 and 7 are depictions of the mask-supporting rail 48; the opposite rail 50 indicated in FIG. 5 is identical in size and shape. The present invention represents a novel modification of the rail configuration fully described and claimed in commonly owned U.S. Pat. No. 4,783,614.

As indicated in FIG. 6, rail 48 ( and companion rail 50) is generally L-shaped in cross-section and has a first leg 60 projecting from faceplate 24 that defines a flat, mask-receiving surface 66 for receiving the shadow mask 52. A second leg 62 is affixed to the inner surface 44 of the faceplate 24, and extends in parallel with inner surface 44. A rib 68, one of a plurality of such ribs spaced along the length of the rail, strengthens the rail 48 and prevents it from tilting inwardly in the direction indicated by arrow 70 in response to the inward pull of the tensioned shadow mask 52. Beads of devitrified solder glass 72 and 74 cement the rail 48 to the inner surface 44 of the faceplate 24.

FIG. 7 is a view of rail 48 and faceplate 24 taken along site lines VII—VII of FIG. 6. The mask-receiving surface 66 of each of the rails 48 and 50 has a predetermined downward curvature from the center 78 to the sides 80 according to the invention effective to bow the shadow mask 52 downwardly, the predetermined curvature of the mask being effective to alleviate degrouping of the electron beams when the CRT 20 is activated.

The curvature of mask-receiving surface 66 from the flat plane indicated by dash line 76 in FIG. 7 is greatly exaggerated for illustrative purposes. Using a 14-inch tube as an example, if the Q-spacing of rail 48 at its center 78 is 0.170 inch, the Q-spacing of each of the ends 80 of rail 48 may be 0.158 inch. Based on these exemplary dimensions, the curvature of the mask-receiving surface of the mask supports 48 and 50 will be seen to be very slight-the radius of the right-circular cylinder curvature of the mask-receiving 66 surface according to the invention is of the order of 1,000 inches. More specifically, and on the basis of the example cited, the radius is 1260 inches.

The selection of the radius depends primarily on how much compensation is needed, primarily in response to the degrouping caused by the type of yoke used. The radius of 1260 inches cited is adequate compensation for yoke that causes only a slight degrouping. A radius of 500 inches for example may be required to compensate for a yoke that causes a more severe degrouping.

Figure 8:
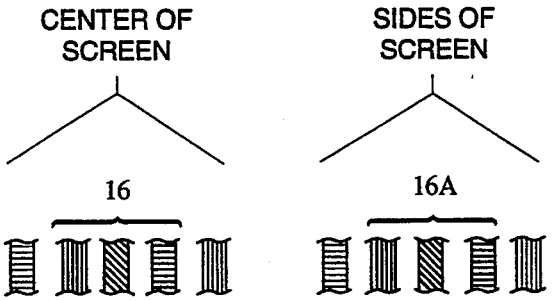
FIG. 8 depicts schematically the alleviation of degrouping as a result of the means according to the invention.

An alleviation of degrouping that can be attributed the curvature of the shadow mask and its support structure according to the invention is illustrated schematically in FIG. 8. In comparison with the grouping status of the trio 16 indicated by FIG. 2B, the grouping status of the same trio 16 when at the side 17 of screen 11 shown by FIG. 8 is slightly but tolerably degrouped as a result of the curvature of the mask according to the invention. The beneficial effect of curving the mask according to the invention is shown by comparing trio 16A of FIG. 8, which indicates a slight degrouping with 16A of FIG. 2B (noted as being the same trio at another location on the screen) which indicates a severe degrouping.

Another benefit of the invention is attributable to the fact that the curvature of the mask ensures that, when a vibration damping wire is laid on the mask, the wire will be in positive contact with all the strips. Improved vibration damping as result of strip-mask curvature is fully described in commonly owned referent copending application Ser. No. 07/998,093.

The curvature of the mask-receiving surfaces of the rails, such as the surface 66 depicted in FIGS. 5 and 6, may be formed by grinding or by electric discharge machining. It is essential, of course, that the mask-receiving surface of each of the rails be formed to have a mirror-image curvature, with a radius of exactly 1260 inches, a figure cited as one example. Also, the rails must be exactly parallel, and there must be no offsetting of the rails when mounted on the inner surface of a faceplate. Using rail 48 depicted in FIG. 6, and its contour 66 depicted in FIG. 7 by way of example, the center 78 and ends 80 of rail 48 must lie in planes precisely perpendicular to the corresponding center and ends of rail 50.

In addition to the rail configuration depicted in FIGS. 6 and 7, a mask support may as well comprise the adjustable-height shadow mask support disclosed in U.S. Pat. No. 5,025,191, or the A-shaped structure disclosed in U.S. Pat. No. 4,739,217, both of common ownership herewith. The shadow-mask receiving surface of the mask-support structures described in these patents can readily be modified to have a predetermined downward curvature from center to sides effective to bow the mask downwardly and alleviate degrouping according to the invention.

While a particular embodiment of the invention has been shown and described, it will be readily apparent to those skilled in the art that changes and modifications may be made in the inventive means and method without departing from the invention in its broader aspects, and therefore, the aim of the appended claims is to cover all such changes and modifications as fall within the true spirit and scope of the invention.

I claim:

1. A Striped-screen tension mask color CRT having a funnel and further comprising:

a) a flat glass faceplate having a flat inner, screen-receiving surface affixed to the funnel;

b) a substantially rectangular screen having an x-axis and a y-axis, the x-axis and the y-axis crossing each other at the center of the screen, and stripes of trios of colored-light-emitting phosphors on the inner screen-receiving surface oriented in a first direction, parallel to the y-axis, and activated by electron beams;

c) a tensed, strip-type foil shadow mask held in fixed relation to the inner screen-receiving surface, with stripes oriented in the first direction, and having a predetermined curvature such that the distance between the shadow mask and the inner screen-receiving surface decreases as the distance increases from the y-axis, the curvature being effective to alleviate degrouping of the electron beams.

2. The striped-screen tension mask color CRT of claim 1 wherein the predetermined curvature is in the form of a right circular cylinder having a radius of curvature in the range of 500 inches to a radius of the order of 1,000 inches.

3. A faceplate assembly for use in a striped-screen color CRT having a strip-type mask, comprising:

a) a flat glass faceplate having a flat inner, screen-receiving surface;

b) a substantially rectangular screen having an x-axis and a y-axis, the x-axis and the y-axis crossing each other at the center of the screen, and stripes of trios of colored-light-emitting phosphors on the inner screen-receiving surface oriented in a first direction, parallel to the y-axis, and activated by electron beams;

c) a stripe-type foil shadow mask with strips oriented in the first direction;

d) two shadow mask supports affixed to the inner surface on the opposed sides of the screen in a second direction normal to the first direction for receiving the mask tensed in the first direction, the supports each having a mask-receiving surface having a predetermined curvature such that the distance between the mask-receiving surface and the inner screen-receiving surface decreases as the distance from the y-axis increases, the curvature being effective to bow the shadow mask and alleviate degrouping of the electron beams.

4. The shadow mask supports of claim 3 wherein the predetermined curvature of the supports forms the mask mounted thereon into the shape of a right circular cylinder having a radius of curvature in the range of •inches to a radius of the order of 1,000 inches.

* * * * *